US008721266B2

(12) United States Patent
Chang et al.

(10) Patent No.: US 8,721,266 B2
(45) Date of Patent: May 13, 2014

(54) COOLING FAN AND ROTOR OF COOLING FAN

(75) Inventors: Yao-Ting Chang, Tu-Cheng (TW); Chao-Ke Wei, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 684 days.

(21) Appl. No.: 12/982,903

(22) Filed: Dec. 31, 2010

(65) Prior Publication Data

US 2012/0107120 A1 May 3, 2012

(30) Foreign Application Priority Data

Nov. 1, 2010 (TW) ..... 99137530 A

(51) Int. Cl.
*F03D 11/00* (2006.01)

(52) U.S. Cl.
USPC ..... 415/119; 416/144; 416/500

(58) Field of Classification Search
USPC ..... 415/119; 416/144, 145, 500
See application file for complete search history.

(56) References Cited

U.S. PATENT DOCUMENTS

| | | | | |
|---|---|---|---|---|
| 7,063,507 | B2 * | 6/2006 | Hsieh | 416/144 |
| 7,281,896 | B2 * | 10/2007 | Yu et al. | 416/144 |
| 2007/0253820 | A1 * | 11/2007 | Liu | 416/144 |
| 2011/0236211 | A1 * | 9/2011 | Schneider et al. | 416/144 |

* cited by examiner

*Primary Examiner* — Edward Look
*Assistant Examiner* — William Grigos
(74) *Attorney, Agent, or Firm* — Novak Druce Connolly Bove + Quigg LLP

(57) ABSTRACT

A cooling fan includes a frame and a rotor received in the frame. The rotor includes a hub, blades extending outwardly and radially from the hub, and a cover plate connected with the hub. The hub includes a top wall and a sidewall extending from a circumference of the top wall. The top wall of the hub defines a plurality of blind holes on an outer surface thereof, and the blind holes are shaded by the cover plate.

14 Claims, 3 Drawing Sheets

COOLING FAN AND ROTOR OF COOLING FAN

BACKGROUND

1. Technical Field

The present disclosure relates to cooling fans typically used in electronic devices, and more particularly to a rotor of a cooling fan.

2. Description of Related Art

Cooling fans are widely used in electronic devices for dissipating heat from heat generating components. A cooling fan often includes a stator, and a rotor rotatably connected with the stator. The cooling fan generates airflow to the heat generating components when the rotor rotates. However, because the rotor is typically formed by injection molding, the weight distribution of the rotor is rarely uniform. Accordingly, the rotor is unbalanced during rotation, which results in noise during operation of the cooling fan.

To solve this problem, in manufacturing of a cooling fan, the weight balance of the rotor can be calibrated. This is done by disposing equilibrium clay on the rotor. Typically, the equilibrium clay is filled onto an inner surface of a hub of the rotor by a tool. However, a magnet included in the hub is liable to be scratched by the tool, and the clay can adhere to the magnet. Both these difficulties can adversely affect the performance of the rotor. In addition, it is inconvenient to fill the equilibrium clay into the inner surface of the hub, and thus the manufacturing of the rotor is time-consuming.

What is needed, therefore, is an improved rotor and cooling fan which can overcome the limitations described.

DETAILED DESCRIPTION

Figure 1:
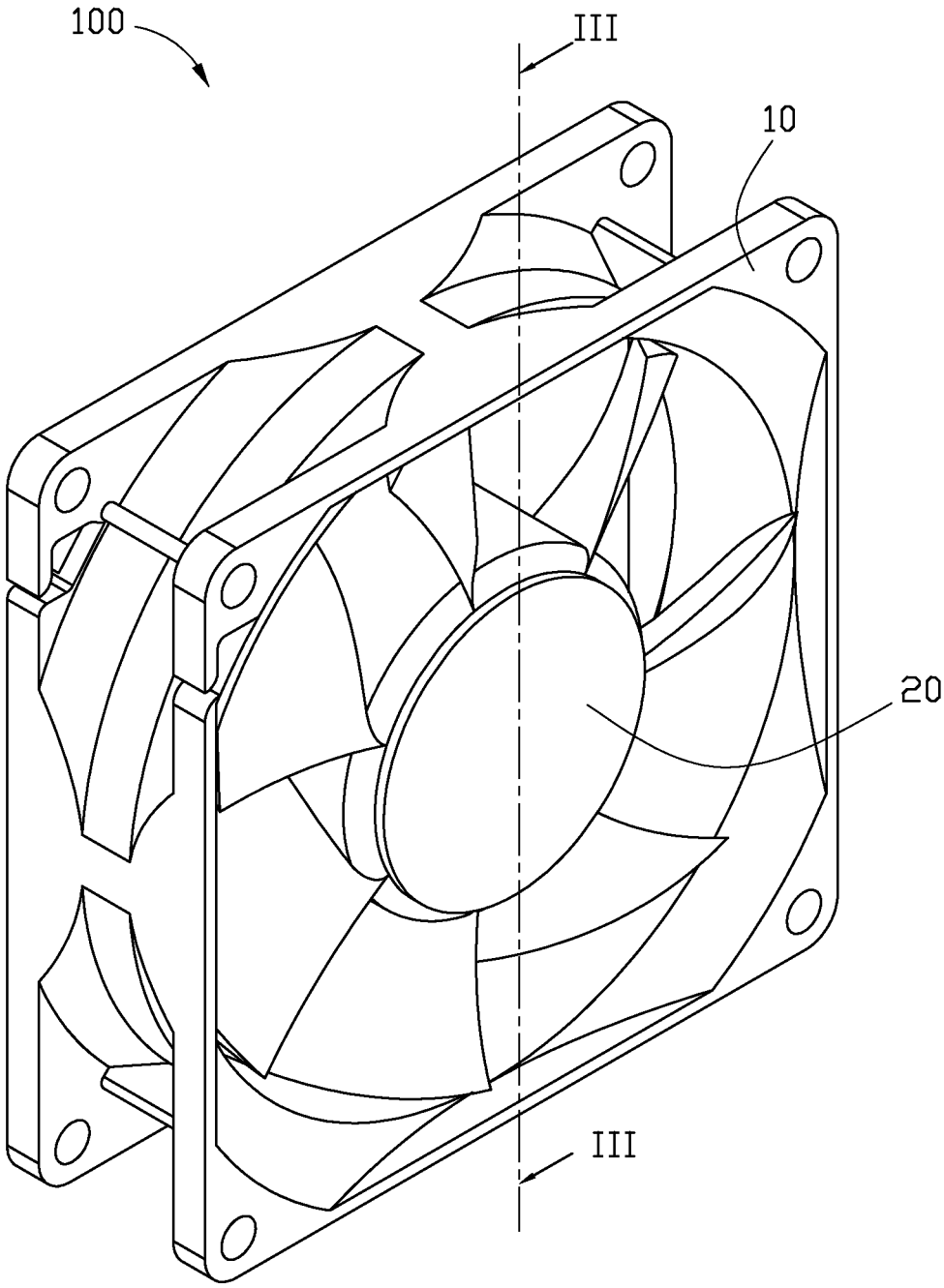
FIG. 1 is an assembled, isometric view of a cooling fan in accordance with an embodiment of the disclosure, the cooling fan including a rotor.

FIG. 1 shows a cooling fan 100 in accordance with an embodiment of the disclosure. The cooling fan 100 includes a frame 10, a stator (not shown) mounted in the frame 10, and a rotor 20 received in the frame 10 and rotatably mounted on the stator.

Figure 2:
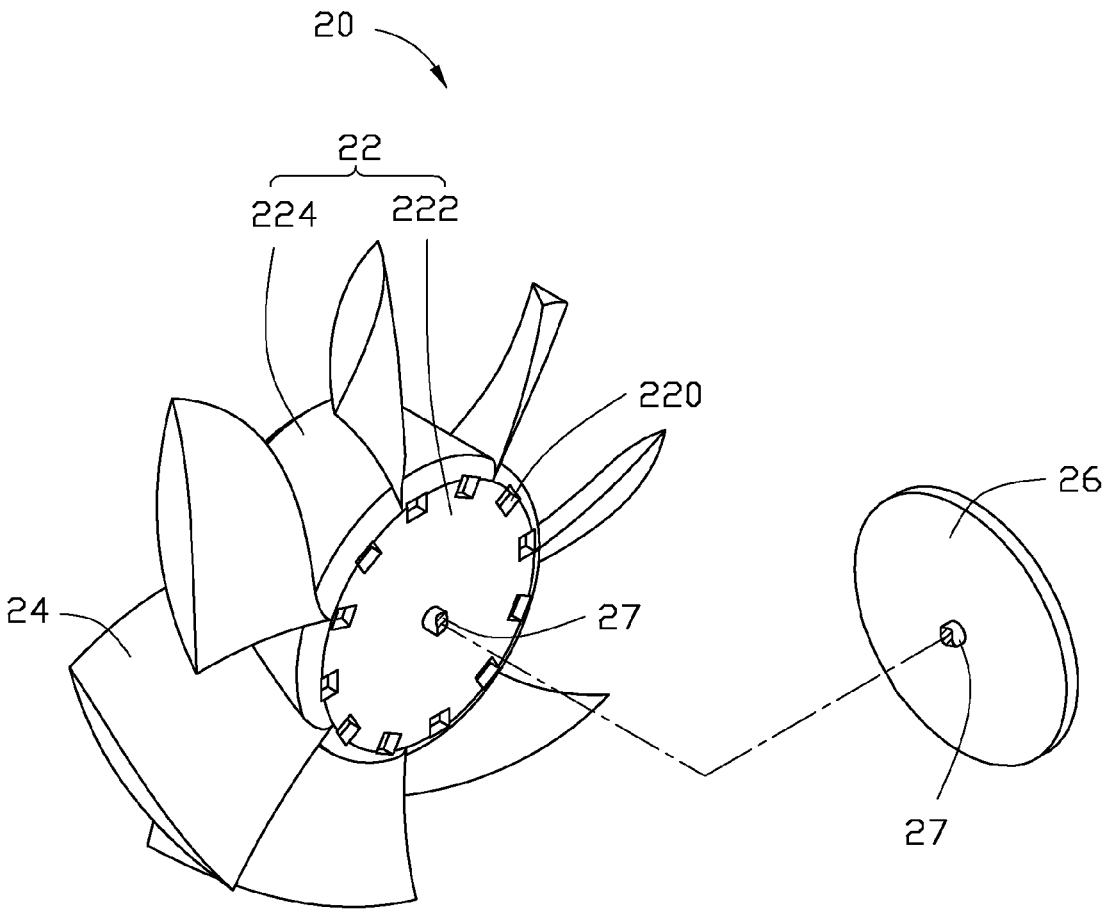
FIG. 2 is an exploded view of the rotor of FIG. 1.
Figure 3:
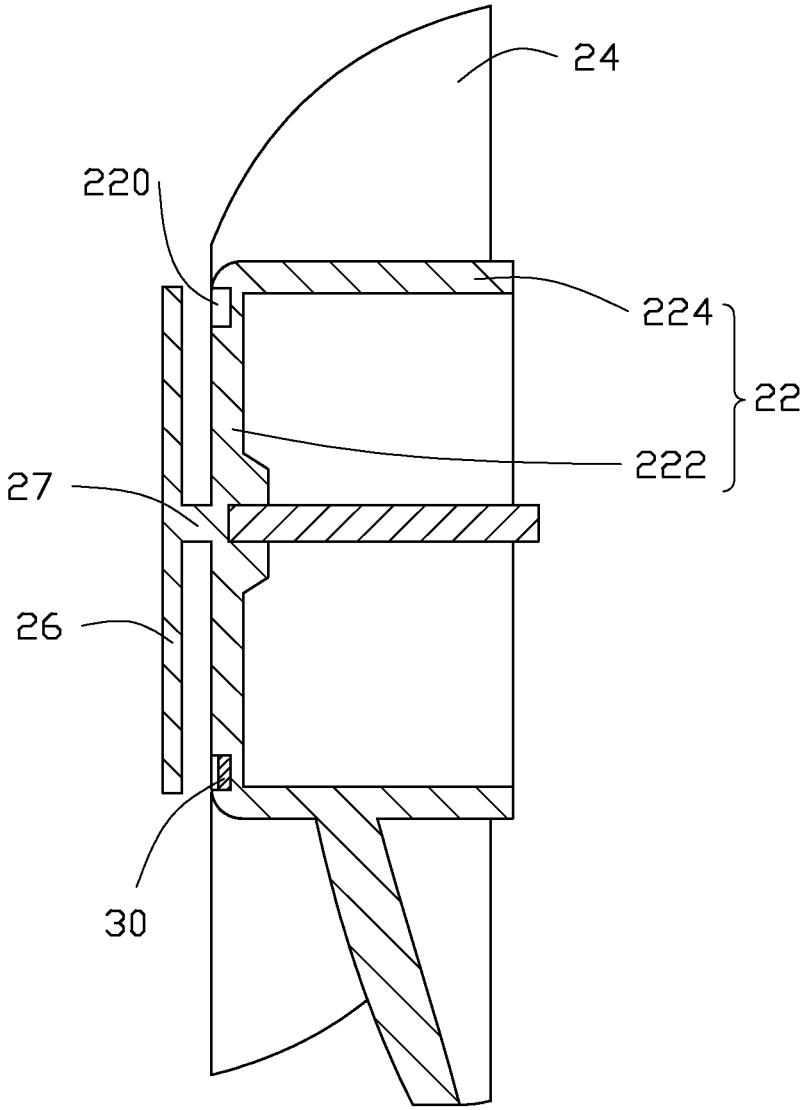
FIG. 3 is a cross section of the rotor of FIG. 1, taken along a line thereof.

Referring also to FIGS. 2 and 3, the rotor 20 includes a hub 22, a plurality of blades 24 extending outwardly and radially from an outer periphery of the hub 22, and a cover plate 26 connected with a top end of the hub 22. The hub 22 includes a circular top wall 222, and a cylindrical sidewall 224 extending perpendicularly from a circumference of the top wall 222. The blades 24 extend outwardly from an outer surface of the sidewall 224. The top wall 222 defines a plurality of blind holes 220 on an outer surface thereof. The blind holes 220 are equally angularly spaced from each other along a circumference of the top wall 222. The blind holes 220 are the same shape and size. In this embodiment, each of the blind holes 220 is a substantially rectangular blind hole.

The cover plate 26 is circular, and has a diameter substantially equaling that of the top wall 222 of the hub 22. The cover plate 26 is aligned with and spaced from the top wall 222, such that the cover plate 26 covers (or shades) the blind holes 220 of the hub 22. A connecting portion 27 extends from a center of the cover plate 26 to a center of the top wall 222 of the hub 22, to thereby connect the cover plate 26 with the top wall 222 of the hub 22. The connecting portion 27 is column-shaped. In this embodiment, the rotor 20 is formed by injection molding, and the hub 22, the connecting portion 27 and the cover plate 26 are formed integrally as one monolithic piece of material.

It is understood that in alternative embodiments, the cover plate 26 and the hub 22 can be separately formed and then fixed together. In addition, the shape of the connecting portion 27 can vary, and be for example a cube or disk.

Referring to FIG. 3, one of the blind holes 220 is filled with equilibrium clay 30. In general, the quantity and positions of the blind holes 22 to be filled with the equilibrium clay 30 are determined during calibration of the weight balance of the rotor 20. For example, a plurality of the blind holes 220 can be filled with the equilibrium clay 30 according to need, with the quantity of the equilibrium clay 30 filled in the different blind holes 220 being non-uniform.

During operation, the rotor 20 rotates to generate airflow. Since one or more of the blind holes 220 defined in the rotor 20 are filled with equilibrium clay 30, rotation of the rotor 20 is stable. Because the blind holes 220 are defined at the outer surface of the hub 22, it is convenient to fill the equilibrium clay 30 during manufacturing, and a magnet (not shown) located in the inner side of the rotor 20 remains out of harm's way and intact during the filling operation. In addition, the blind holes 220 are shaded by the cover plate 26, such that no equilibrium clay 30 can be observed from the outside of the rotor 20. That is, an outer appearance of the rotor 20 is aesthetically pleasing.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A rotor, comprising:

a hub comprising a top wall and a sidewall extending from a circumference of the top wall, a plurality of blind holes defined in an outer surface of the top wall for receiving equilibrium clay;

a plurality of blades extending outwardly and radially from an outer surface of the sidewall of the hub;

a cover plate connected to the outer surface of the top wall and covering the blind holes; and a connecting portion connecting a central portion of the cover plate with a central portion of the top wall;

wherein the hub, the connecting portion, and the cover plate are integrally formed as one monolithic piece of material.

2. The rotor of claim 1, wherein the connecting portion is column-shaped.

3. A cooling fan, comprising:

a frame; and a rotor rotatably received in the frame, the rotor comprising:

a hub comprising a cylindrical sidewall and a top wall sealing one end of the sidewall, an outer surface of the top wall of the hub defining a plurality of blind holes for receiving equilibrium clay;

a plurality of blades extending outwardly and radially from an outer surface of the sidewall of the hub; and a cover plate connected with a central portion of the outer surface of the top wall and shading the blind holes, a circumferential portion of the cover plate spaced from the outer surface of the top wall of the hub.

4. The cooling fan of claim 3, wherein each of the blind holes is rectangular.

5. The cooling fan of claim 3, wherein the blind holes are equally angularly spaced from each other along a circumference of the top wall of the hub.

6. The cooling fan of claim 3, wherein the cover plate has a size substantially equaling that of the top wall of the hub.

7. The cooling fan of claim 3, wherein a connecting portion is formed between and interconnecting central portions of the cover plate and the top wall.

8. The cooling fan of claim 7, wherein the connecting portion is column-shaped.

9. A rotor for a cooling fan, the rotor comprising:

a hub comprising a top wall and a sidewall extending from a circumference of the top wall, an outer surface of the top wall of the hub defining a plurality of blind holes for receiving equilibrium clay;

a plurality of blades extending outwardly and radially from an outer surface of the sidewall of the hub; and a cover plate connected with a central portion of the outer surface of the top wall, wherein a circumferential portion of the cover plate is spaced from the outer surface of the top wall of the hub, such that the cover plate shades the blind holes of the top wall of the hub.

10. The rotor of claim 9, wherein each of the blind holes is rectangular.

11. The rotor of claim 9, wherein the blind holes are equally angularly spaced from each other along a circumference of the top wall of the hub.

12. The rotor of claim 9, wherein the cover plate has a size substantially equaling that of the top wall of the hub.

13. The rotor of claim 9, wherein the cover plate is connected with the top wall of the hub by a connecting portion.

14. The rotor of claim 13, wherein the connecting portion is column-shaped.

* * * * *